United States Patent [19]

McDonnell

[11] 4,076,203

[45] Feb. 28, 1978

[54] WALL SHELF ARRANGEMENT

[76] Inventor: Thomas M. McDonnell, 11 N. 4th Ave., Maywood, Ill. 60153

[21] Appl. No.: 806,745

[22] Filed: Jun. 15, 1977

[51] Int. Cl.[2] ..... A47B 57/16

[52] U.S. Cl. ..... 248/247; 248/250; 108/108; 211/187

[58] Field of Search ..... 108/108, 109, 152; 248/250, 247, 248; 211/186, 187, 192, 191

[56] References Cited

U.S. PATENT DOCUMENTS

| | | | |
|---|---|---|---|
| 1,324,537 | 12/1919 | Belcher | 108/108 |
| 1,535,741 | 4/1925 | Snodgrass | 248/250 X |
| 2,819,863 | 1/1958 | Vines | 248/247 |
| 3,269,338 | 8/1966 | Shewell | 108/109 X |
| 3,352,428 | 11/1967 | Sak et al. | 211/187 X |
| 3,463,325 | 8/1969 | Zagotta | 211/187 X |
| 3,984,077 | 10/1976 | Shine | 248/248 |

*Primary Examiner*—Francis K. Zugel

[57] ABSTRACT

An adjustable wall shelf arrangement including a pair of slotted vertical members, for supporting a shelf, and retaining members engageable with the shelf and the vertical members for preventing the former from coming out of a slot of the latter.

9 Claims, 4 Drawing Figures

WALL SHELF ARRANGEMENT

SUMMARY OF THE INVENTION

This invention relates to wall shelf arrangements of the type wherein one or more horizontal shelves are received within aligned, vertically spaced slots of a pair of vertical support members attached to a wall.

It is an object of the invention to provide, in an arrangement of the type described, a novel retaining member detachably engageable with both a shelf and a vertical supporting member to prevent the former from accidentally coming out of a slot in the latter.

A more specific object of the invention is the provision of a wall shelf arrangement which includes a plurality of retaining members, each of which includes a rear portion engageable with a supporting member and having a forward portion with a projection in the form of a tang which engages the shelf.

These and other objects of the invention will be apparent from an examination of the following description and drawings.

THE DRAWINGS

It will be understood that, for purposes of clarity, certain elements may have been intentionally omitted from certain views where they are believed to be illustrated to better advantage in other views.

THE DESCRIPTION

Figure 1:
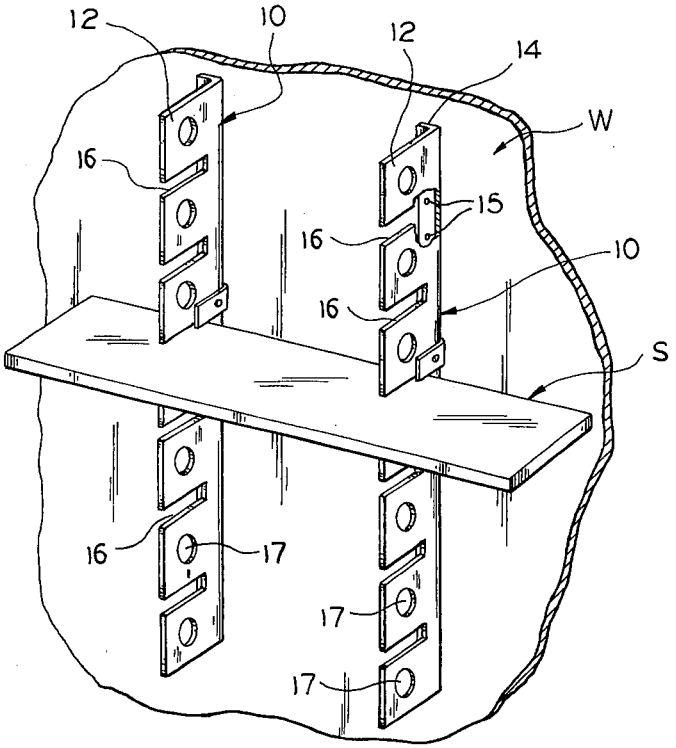
FIG. 1 is a fragmentary perspective view of a wall shelf arrangement embodying features of the invention.

Referring now to the drawings for a better understanding of the invention, it will be seen that there is illustrated in FIG. 1 a wall shelf arrangement which includes at least one horizontal shelf member S which is supported by a pair of vertical support members, indicated generally at 10, and which are mounted on a flat vertical surface such as that of a wall W.

Each of the vertical members 10 includes a main or primary panel 12, which is relatively thin and narrow, and a generally flat retaining flange 14 which is preferably formed integrally with and projects at a right angle to the rear edge of the main panel.

The vertical members 10 may be secured to walls W by means of nails or screws 15 extending through retaining flanges 14.

At their forward ends, each of the vertical member main panels 12 is provided with a plurality of horizontally spaced, forwardly facing, preferably rectangular slots 16, each adapted to receive a portion of a shelf S. Vertical member main panels 12 may also be provided with a plurality of openings or holes 17 of any denied shape to provide a decorative design and reduce the amount of material required therefor.

Figure 2:
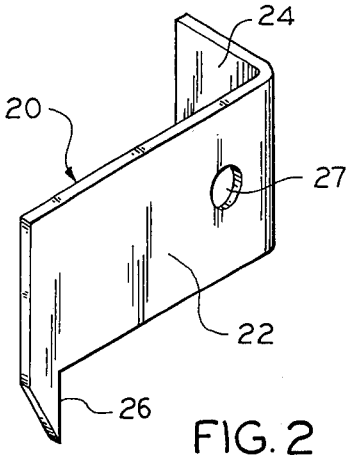
FIG. 2 is an enlarged perspective view of a shelf retaining member of the type shown in FIG. 1, and FIGS. 3 and 4 are views similar to FIGS. 1 and 2, respectively, but illustrate a modified form of the invention.

The essential feature of the invention resides in the provision of the novel retaining members 20, as illustrated in FIG. 2.

Retaining members 20 are used to prevent the shelf S from accidentally coming out of or being removed from the slots 16 of the vertical support members.

As best seen in FIG. 2, retaining member 20 includes a vertical main panel 22, extending in a plane which is generally normal to the wall on which the shelf is being mounted, and an integral, vertical flange 24 extending from the rear edge of main panel 22 in a direction normal thereto for insertion, in a sandwich manner, between the rear surface of related vertical support member flange 14 and the surface of wall W.

At the forward end of the main panel 22 there is provided a downwardly projecting, pointed lug or tang 26 adapted to be inserted into the upper surface of shelf S. which is preferably formed of wood.

Thus, with the rear flange of the retaining member engaged behind the vertical support and with the tang engaging the shelf, accidental movement of the shelf out of the related slot is prevented.

Figure 3:
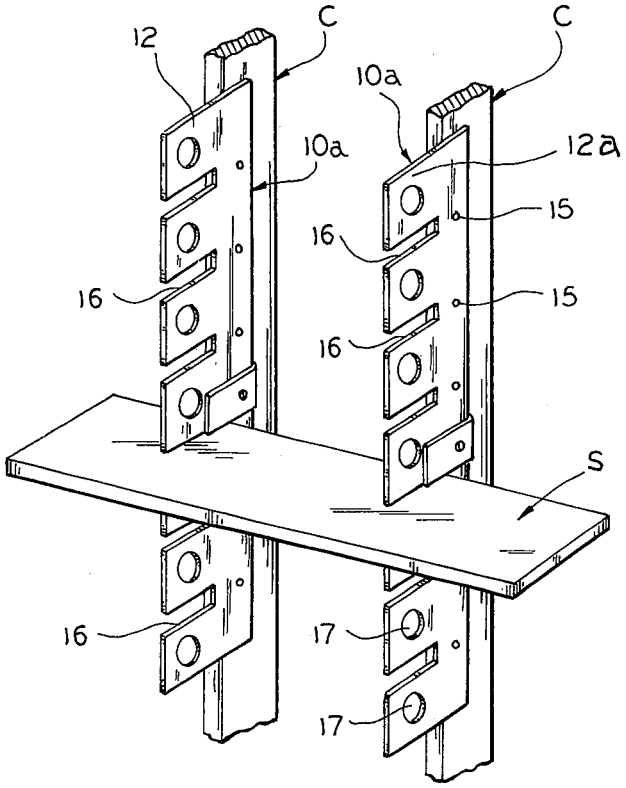
Figure 4:
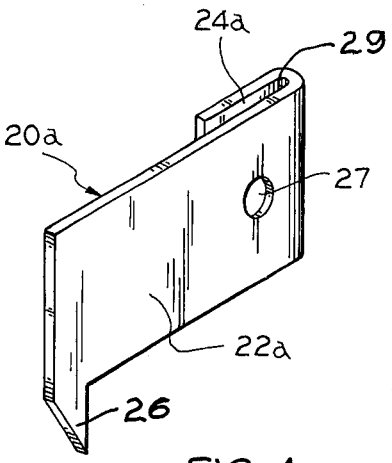

Referring now to FIGS. 3 and 4 of the drawings, it will be seen that a modified form of the invention is shown.

In this alternate embodiment of the invention, the shelf supporting vertical members **10*a*** are adapted to be secured to the sides of studs or vertical columns rather than against a flat surface parallel to the longitudinal axis of the shelf, as in the case of the previous embodiment.

In this arrangement, main panels **12*a* of the vertical support members 10*a* may be directly secured, as by nails or screws 25**, to the sides of a column C, and there is no need for retaining flanges on the vertical support members as in the case of the previously described embodiment.

With respect to the retaining member **20*a*, the retaining flange 24*a* is bent around approximately from the rear edge of main panel 22*a* so as to lie parallel to main panel 22*a* and form therewith a narrow slot 29 within which is received the main panel 12*a* of a vertical support member 10*a* to prevent the forward movement of the retaining member 20*a***.

At its forward end, main panel **22*a* is provided with a downwardly projecting, integral tang 26 which functions in the same manner as that of the previous embodiment to prevent accidental movement of the shelf S out of the slot 16**.

Thus, it will be understood that the invention provides an adjustable shelf arrangement of simple design and economic construction which utilizes the novel retaining members to insure that the shelves will remain in the slots of the vertical supporting members.

I claim:

1. In a wall shelf arrangement, the combination of:

(a) a pair of vertical support members attachable to a vertical surface such as a wall structure;

(b) said support members each having a plurality of forwardly facing, vertically spaced slots for removably receiving a plurality of horizontally disposed shelves;

(c) a plurality of shelf retaining members for detachably securing said shelves to said support members, each of said retaining members comprising:

(i) a first element adapted to be engaged behind a portion of a vertical support member;

(ii) a second element formed integrally with and extending forwardly from said first element and adapted to overlie an upper surface of a shelf;

(iii) a third element formed integrally with and projecting downwardly from a forward portion of said second element and adapted to extend below the upper surface of said shelf for engagement with said shelf to prevent the accidental forward movement of said shelf out of the related slot of the related support member.

2. A shelf arrangement according to claim 1, wherein said vertical members each include:

(a) a relatively thin, flat, elongated main panel disposed to extend forwardly in a direction generally normal to said vertical wall surface;

(b) a relatively thin, flat, integral flange disposed to extend in a direction normal to said main panel and parallel to said vertical wall surface for attachment thereto.

3. A shelf arrangement, according to claim 1, wherein said vertical support members each comprise a single, relatively thin, flat, elongated panel.

4. A shelf arrangement, according to claim 1, wherein the first element of said retaining member is a relatively thin, flat panel.

5. A shelf arrangement, according to claim 4, wherein the second element of said retaining member is a relatively thin, flat panel disposed to extend in a direction normal to said first element.

6. A shelf arrangement, according to claim 4, wherein the second element of said retaining member is a relatively thin, flat panel which is bent forwardly approximately 180° from the rear extremity of said first element to form with said first element a relatively narrow slot for receiving a rear portion of related vertical support member.

7. A shelf arrangement, according to claim 1, wherein said third element of said retaining member comprises a relatively pointed tang adapted to be pushed a slight distance into the upper surface of a shelf.

8. A shelf arrangement, according to claim 1, wherein said vertical support members are provided with a plurality of vertically spaced openings located adjacent said slots.

9. In a wall shelf arrangement, the combination of:

(a) a pair of relatively thin, flat, elongated vertical support members having rear portions adapted to be attachable to a vertical surface such as a wall structure;

(b) said support members each having a plurality of forwardly facing, vertically spaced slots for removably receiving a plurality of horizontally disposed shelves;

(c) a plurality of shelf retaining members for detachably securing said shelves to said support members, each of said retaining members comprising:

(i) a flange element adapted to be engaged behind a portion of a vertical support member;

(ii) a main panel element formed integrally with and extending forwardly from said flange element and adapted to overlie an upper surface of a shelf;

(iii) a tang element formed integrally with and projecting downwardly from a forward position of said main panel element and adapted to extend below the upper surface of said shelf for engagement with said shelf to prevent the accidental forward movement of said shelf out of the related slot of the related support member.

* * * * *